US010549299B2

(12) United States Patent
Knight

(10) Patent No.: US 10,549,299 B2
(45) Date of Patent: Feb. 4, 2020

(54) PUMP DISPENSERS

(71) Applicant: Rieke Packaging Systems Limited, Leicester (GB)

(72) Inventor: Simon Christopher Knight, Bridgend (GB)

(73) Assignee: Rieke Packaging Systems Limited, Liecester (GB)

( * ) Notice: Subject to any disclaimer, the term of this patent is extended or adjusted under 35 U.S.C. 154(b) by 0 days.

(21) Appl. No.: 15/489,849

(22) Filed: Apr. 18, 2017

(65) Prior Publication Data

US 2017/0216864 A1 Aug. 3, 2017

Related U.S. Application Data

(63) Continuation of application No. PCT/GB2015/053086, filed on Oct. 16, 2015.

(30) Foreign Application Priority Data

Oct. 20, 2014 (GB) ..... 1418658.9

(51) Int. Cl.
*B05B 11/00* (2006.01)

(52) U.S. Cl.
CPC ..... *B05B 11/3032* (2013.01); *B05B 11/0041* (2018.08); *B05B 11/3015* (2013.01); *B05B 11/3059* (2013.01)

(58) Field of Classification Search
CPC ..... B05B 11/3032; B05B 11/3015; B05B 11/004; B05B 11/3028; B05B 11/3035; B05B 11/3059; F04B 43/00
See application file for complete search history.

(56) References Cited

U.S. PATENT DOCUMENTS

| | | | | |
|---|---|---|---|---|
| 4,071,172 | A | 1/1978 | Balogh | |
| 4,162,746 | A | 7/1979 | Anderson | |
| 4,218,198 | A | 8/1980 | Kutik | |
| 4,858,788 | A * | 8/1989 | Meckenstock | B05B 9/0883 222/207 |
| 4,867,347 | A * | 9/1989 | Wass | B05B 11/3015 222/153.13 |
| 5,002,228 | A | 3/1991 | Su | |

(Continued)

FOREIGN PATENT DOCUMENTS

| | | |
|---|---|---|
| DE | 1728474 | 8/1973 |
| DE | 3316308 | 11/1983 |

(Continued)

OTHER PUBLICATIONS

Search Report from PCT/GB2015/053086 dated Mar. 11, 2016.

(Continued)

*Primary Examiner* — David P Angwin
*Assistant Examiner* — Bob Zadeh
(74) *Attorney, Agent, or Firm* — McDonald Hopkins LLC

(57) ABSTRACT

A pump dispenser has a deformable pump chamber constituted by first and second part-chambers each having a respective resiliently deformable faceted chamber wall and a connecting conduit communicating between them. They may be moulded in one piece and require no separate restoring spring. The first and second part-chambers may be disposed in line between a pump body providing an inlet valve from a container and a movable actuator cap providing a valved outlet.

13 Claims, 4 Drawing Sheets

(56) References Cited

U.S. PATENT DOCUMENTS

| | | | | |
|---|---|---|---|---|
| 5,462,208 | A * | 10/1995 | Stahley | B05B 7/0037 222/190 |
| 5,579,958 | A | 12/1996 | Su | |
| 6,186,364 | B1 | 2/2001 | Dobbs | |
| 6,279,784 | B1 * | 8/2001 | O'Neill | B05B 11/0016 222/207 |
| 8,616,414 | B2 * | 12/2013 | Ciavarella | B05B 7/0037 222/1 |
| 2017/0216864 | A1 * | 8/2017 | Knight | B05B 11/004 |

FOREIGN PATENT DOCUMENTS

| | | |
|---|---|---|
| EP | 0720951 | 7/1996 |
| EP | 1 939 111 A1 | 7/2008 |
| GB | 1304903 | 1/1973 |
| GB | 1417955 | 12/1975 |
| GB | 2008185 | 5/1979 |
| GB | 2122692 | 1/1984 |
| WO | WO2007/031614 | 3/2007 |
| WO | WO2008/072833 | 6/2008 |
| WO | WO2008/150810 | 12/2008 |
| WO | WO2011064584 | 6/2011 |
| WO | WO 2012/104694 A1 | 8/2012 |

OTHER PUBLICATIONS

United Kingdom Intellectual Property Office, Patent Search Report for Claim 18 GB1418658.9, dated Jul. 18, 2017.
United Kingdom Intellectual Property Office, Patent Search Report for Claims 16-17 GB1418658.9, dated Jul. 17, 2017.
United Kingdom Intellectual Property Office, Patent Search Report for Claims 14-15 GB1418658.9, dated Jul. 17, 2017.

* cited by examiner

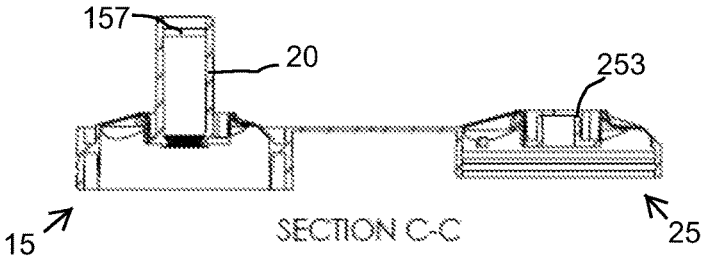
Fig. 3(a)
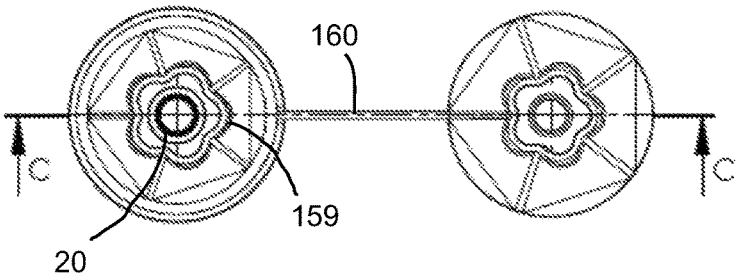
Fig. 3(b)
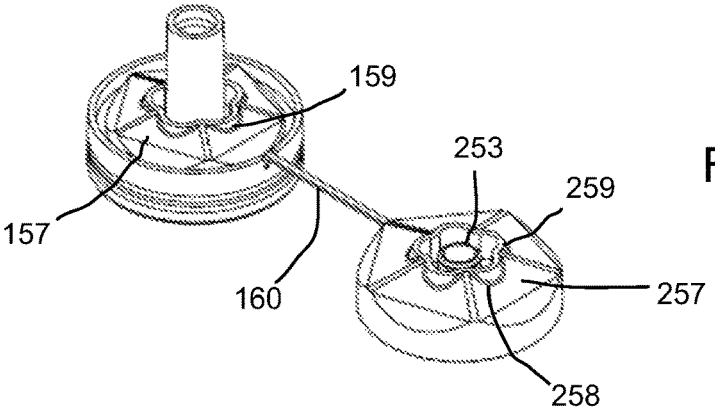
Fig. 3(c)
Fig. 4(a)
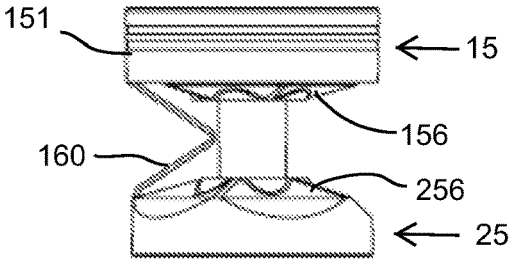
Fig. 4(b)
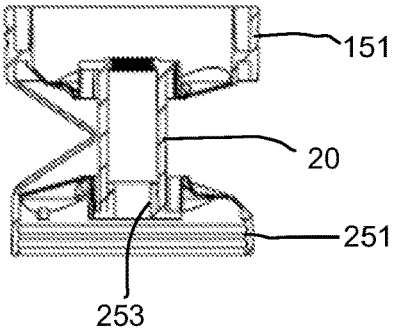

Fig. 5(a)
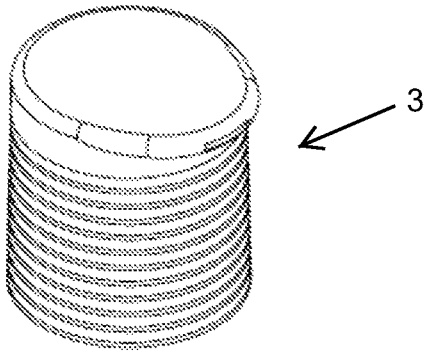
Fig. 5(b)
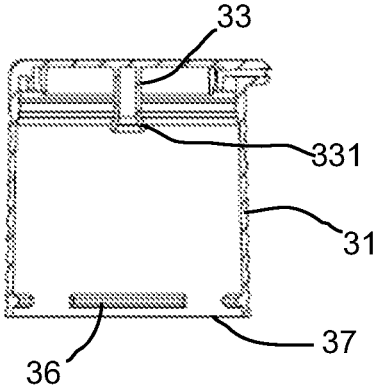
Fig. 6(a)
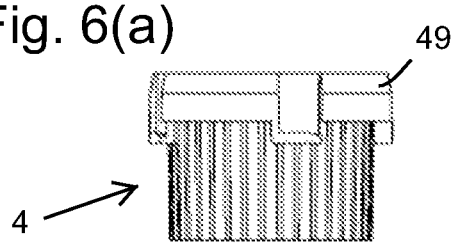
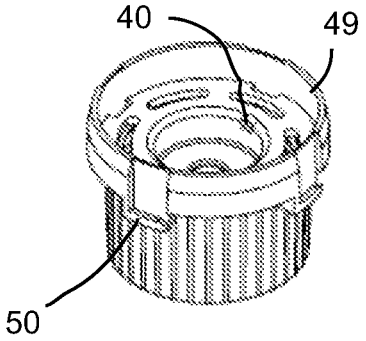
Fig. 6(b)
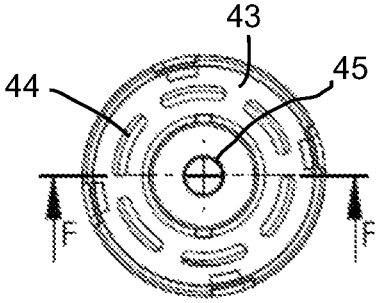
Fig. 6(c)
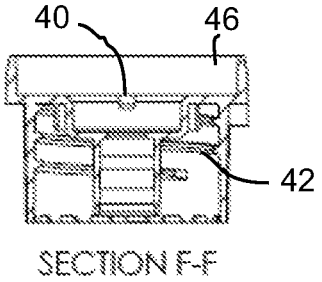
Fig. 6(d)

PUMP DISPENSERS

CROSS REFERENCE TO RELATED APPLICATION

This application is a continuation of PCT/GB2015/053086 filed Oct. 16, 2015, which claims the benefit of United Kingdom Application No. 1418658.9 filed Oct. 20, 2014, which are hereby incorporated by reference.

BACKGROUND

This invention relates to pump dispensers, of the kind having a pump module mounted on a container of a flowable product to be dispensed.

In a conventional dispenser pump the basic functional elements are a pump chamber of variable volume, having an inlet from the container and an outlet to a discharge opening, and an actuator operable to change the volume of the pump chamber to draw product into the pump chamber and expel the product through the discharge opening. At least the inlet and often also the outlet generally have one-way valves for efficient action. The simplest and cheapest pumps are movable-nozzle piston-and-cylinder pumps in which a reciprocable plunger carries a piston which works in a cylinder defined by a body of the pump and which fixes onto the container neck. Usually a ball valve is provided for the inlet, and often for the outlet. A return spring acts between the pump body and plunger to urge the latter to its extended position, automatically re-filling the pump chamber after each dispensing stroke.

While these pumps are reliable and effective, they usually use metal for the pump springs and often for the ball valves, making recycling difficult. In the simplest designs the metal also contacts the product which may be undesirable.

Over the years there have been many proposals for avoiding the use of metal in pumps. Deformable pump chambers, typically using bellows constructions and/or elastomer or thermoplastic elastomer materials, have been proposed and used. However these materials are expensive as well as usually non-recyclable, while bellows-form chambers are seldom effective.

U.S. Pat. No. 4,867,347 proposed a pump chamber having a resiliently restorable flexible wall which could be made from standard plastics such as polypropylene. Restoring force is provided by a special form of the flexible wall, comprising at least one facet having a concave boundary and a curved surface portion interrupting the facet to induce bending thereof in the dispensing stroke, this bending producing a strong restoring force tending to restore the flexible wall to the rest condition. The curved surface portion—typically a cylindrical surface portion—is axially inclined to the facet and meets it along the concave boundary. In the preferred form the flexible wall has the shape of a polygonal pyramid with plural facets. This structure has the advantage that it can be molded integrally with adjacent components, such as thicker portions for guiding the movement or mounting the flexible wall. However the restoring force achieved is often inadequate and the design did not become commercially used.

Here we propose novel forms of pump dispenser addressing the above issues.

SUMMARY

In a first aspect the invention provides a pump dispenser comprising a pump having a deformable pump chamber with an inlet and an outlet, and a pump actuator operable by moving relative to a body of the pump to vary the volume of the deformable pump chamber for pumping, wherein the pump chamber comprises first and second part-chambers each having a respective deformable chamber wall and a connecting conduit communicating between the first and second part-chambers.

The first and second part-chambers may be disposed so as both to be compressed at the same time by the pump actuator in a dispensing stroke thereof.

The first and second part-chambers may be compressed towards one another by the pump actuator in a dispensing stroke thereof. For example they may be disposed in line between a pump body and an actuator which is moved towards the pump body in the dispensing stroke. One or both of the first and second part-chambers may have a rigid wall portion and a deformable wall portion. The first and second part-chambers may be disposed with the deformable wall portion of one facing the other, and preferably respective deformable wall portions of each facing the other. The connecting conduit between them may be non-deformable. It may drive deformation of their respective deformable wall portions as they are pushed together by the actuator.

Desirably the pump inlet, which is preferably valved, leads into one of the part-chambers and the outlet, also desirably valved, leads out from the other so that dispensed product passes through the part-chambers in series.

Preferably the deformable wall portion of at least one and preferably both of the first and second part-chambers is resiliently deformable and tends to recover to an extended position of the part-chamber after actuation in the dispensing stroke. More preferably the dispenser relies on the resilience of the resiliently deformable wall portions to return the pump to the extended or rest condition after a dispensing stroke. The pump may have no return spring other than the chambers themselves.

Preferably one or both of the part-chamber has a resiliently restorable flexible wall comprising a plurality of mutually angled facets. Additionally or alternatively, a non-elastomeric flexible wall comprising at least one facet having a concave boundary and a curved surface portion which interrupts the facet to induce bending thereof in the dispensing stroke, this bending producing a reaction force tending to restore the flexible wall to the rest/extended condition. The curved surface portion may be a cylindrical surface portion, e.g. axially inclined to the facet, and meeting it along the concave boundary. One or both flexible walls may be made of polypropylene. The flexible walls of the first and second chambers may be formed in one piece with one another, and/or one of them may be formed in one piece with the connecting conduit.

The part-chambers may be constituted by a rigid body member, an actuator member reciprocable relative to the rigid body member, a first one-piece resiliently deformable wall component defining the first part-chamber in combination with the body member and a second one-piece resiliently deformable wall component defining the second part-chamber in combination with the actuator member, the connecting conduit being a preferably rigid tube extending between them e.g. in the direction of reciprocation.

The actuator is preferably a reciprocable plunger. Desirably the actuator and pump body enclose the part-chambers and conduit between them. One or both of actuator and pump body may have cap or cup form.

Preferably all of the above-mentioned pump components and more preferably also an inlet valve and an outlet valve are non-metal, and preferably without elastomer components. Most desirably all of the mentioned components are of polypropylene.

A second aspect relates to sealing a pump against leakage. According to our proposal, which may be embodied in a pump dispenser of the first aspect if desired, the pump has a plunger biased to an extended position relative to a pump body. The fluid pathway in the pump (between inlet and discharge) passes through a restricted opening in a pump component which is movable relative to the plunger in the direction of plunger movement. Another pump component, such as the plunger or body, comprises or carries an enlarged blocking element which enters and blocks said restricted opening in the extended position of the plunger, but not in the retracted or depressed position thereof. For example, the plunger may have an internal projection with an enlarged blocking element inside a deformable pump chamber, projecting through the pump chamber in the direction of plunger movement and entering a restricted opening on the opposite side of the pump chamber.

The pump chamber in this aspect may have any of the pump chamber or dispenser features listed above for the first aspect.

A third aspect relates to the disposition of a locking feature that can be used to prevent undesired actuation of a pump plunger. In this aspect, a pump plunger is reciprocable in a pumping stroke relative to a pump body. One of the plunger and body (the outside component) has an open mouth that surrounds and moves onto the other of the plunger and body (the inside component) in the pumping stroke. A locking mechanism comprises selectively engageable interlock formations on the outside of the inside component and preferably on the inside of the outside component, e.g. at or adjacent the mouth of the latter. The interlock formations may be selectively engageable/disengageable by rotating the components relative to one another around the plunger axis. In preferred embodiments, an interlock formation on the outside component that normally makes a stop engagement with the inside component during dispensing to prevent escape of the plunger is alternatively engageable with different formations of the inside component to prevent actuation.

This proposal may be combined with the first and/or second aspects above, especially when the actuator is in the form of a cap which contains the pump chamber(s).

A fourth aspect relates to the venting of air, i.e. the controlled admission of air into a container of a pump dispenser, such as a dispenser of any of the above aspects, to compensate for the volume of product dispensed. In this aspect a vent path enters the dispenser between a container neck and a closure component of the pump secured onto the neck e.g. by a screw thread. The closure component also comprises an inlet formation of the pump, including an inlet opening, and a valve unit is disposed at the inlet. The valve unit comprises a layer portion lying in proximity to the closure component adjacent the inlet but also having a region spaced from the closure component by a clearance. The vent path enters the clearance between the valve unit layer portion and the closure component, and runs to the inlet opening behind the valve unit. The dispenser may comprise a vent valve for opening through said closure component into said clearance. The vent valve may be comprised in a body formed in one piece with the inlet valve and optionally a surround thereof comprising said layer portion.

BRIEF DESCRIPTION OF THE DRAWINGS

An embodiment of the above proposals is now described by way of example with reference to the accompanying drawings in which

FIGS. 3(*a*), (*b*) and (*c*) are respectively a section at C-C, a plan view and a perspective view of a pair of pump chamber-defining deformable members in as-manufactured state;

FIGS. 4(*a*), (*b*) are a side elevation and a vertical axial cross-section through the pump chamber-defining members, now connected together to form a single pump chamber in combination;

FIGS. 5(*a*), (*b*) are respectively a perspective view and a vertical axial cross-section of an actuator cap of the dispenser;

FIGS. 6(*a*), (*b*), (*c*) and (*d*) are respectively an elevation, a perspective view, a plan view and a vertical axial sectional view of a pump body component which secures to the container neck;

DESCRIPTION OF THE SELECTED EMBODIMENTS

Figure 1:
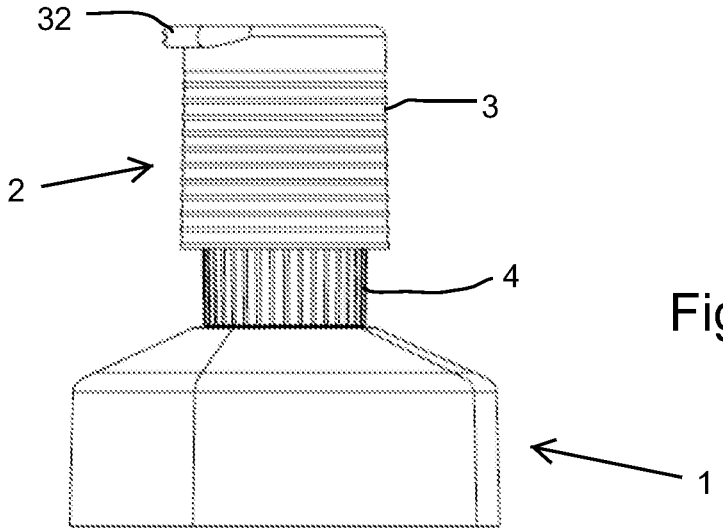
FIG. 1 is an elevation of a pump dispenser.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 2:
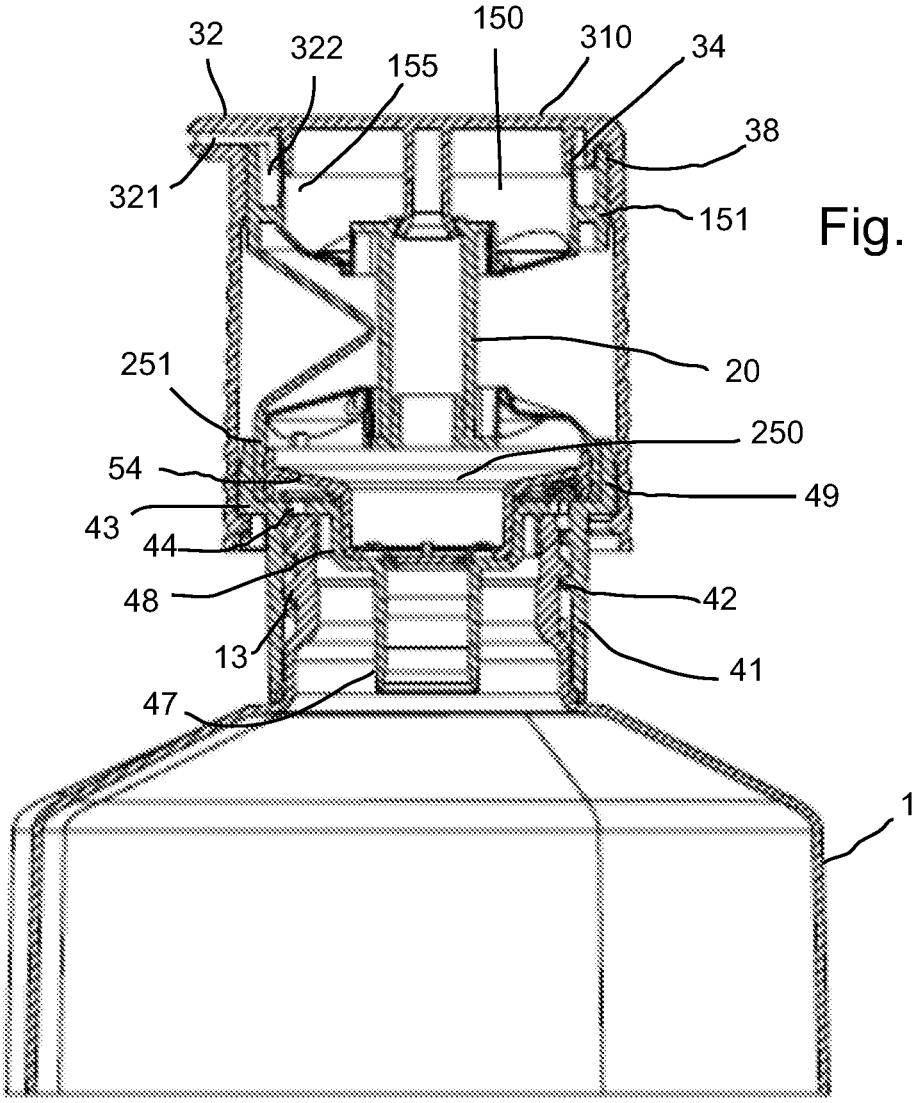
FIG. 2 is a vertical axial cross-section through the dispenser, at a larger scale.
Figure 7:
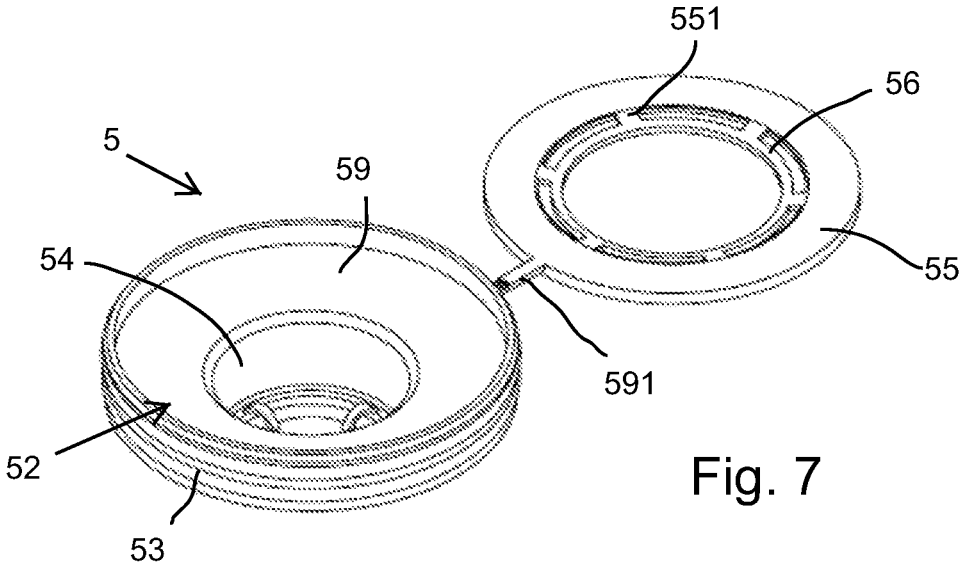
FIG. 7 is a perspective view of a valve body unit in an as-manufactured state, and FIGS. 8 (*a*), (*b*) and (*c*) show the valve body unit prepared for installation in the dispenser.

FIG. 1 shows a bottle 1 having a pump 2 mounted on its neck. FIG. 2 shows that the bottle neck carries an external securing thread 13. The pump 2 has a pump body 4 by which it is secured to the container. The body includes a cap portion comprising a cylindrical cap skirt 41 and a cover flange 43, the skirt 41 having internal threads 42 which engage the neck threads 13. The cover flange 43 extends radially in across the neck edge and turns down to a central inlet recess 48 which projects down into the container neck and has at its bottom an inlet hole 45, surrounded by an inlet valve seat 46 (FIG. 6), with a dip tube socket 47 projecting below (the dip tube is present but not shown). At its periphery, the cover flange 43 extends radially slightly out beyond the cap skirt 41 and meets an upstanding support surround 49 which locates other components described below.

A plunger actuator or actuator cap 3 is mounted over the pump body 4, and has a generally enclosed cylindrical side wall 31 and flat top wall 310 and is open at the bottom, at a downward mouth 37. The downward mouth and cylindrical side wall 31 fit round the support surround 49 of the pump body so that the actuator cap can slide up and down over the body 4, altering the height and volume of the cavity defined between them.

The top of the cap 3 has a nozzle or spout 32 which opens laterally and connects to the interior via a discharge channel 321 which connects in turn to an annular discharge space 322 inside the cap.

Upper and lower pump chamber-defining members 15,25 are contained in the cavity defined between the actuator cap 3 and pump body 4, and define or enclose, in combination with the cap and body respectively, a top part-chamber 150 and a bottom part-chamber 250 which communicate through a connecting tube 20. See FIGS. 3 and 4. Each chamber-defining member 15,25 comprises a resiliently deformable membrane or flexible wall 156,256 connected integrally to a respective peripheral securing ring 151,251 by which it is secured against the side wall of the cavity between the actuator cap 3 and the pump body 4.

Each of the resilient membrane portions is formed to have a strong tendency to restore to its rest condition from deformation in either direction. The lower member 25 has its flexible wall/membrane 256 formed integrally with the thicker peripheral securing ring 251 which anchors inside the support surround 49 of the pump body 4 to hold it in place. The flexible wall 256 is generally in the form of a downwardly directed conical polygon or polygonal pyramid with five facets 257, best seen in FIG. 3. The respective facets are substantially planar in the rest condition shown in FIGS. 2 and 3, each angled at about 30° to the plane common to their bases. At the radially inner (higher) part of each facet 257 it is intersected, along a concave boundary 258, by a cylindrical surface portion 259 the central line of which lies in the same radial plane of the pyramid as does the centre line of each facet 257. Inward of the cylindrical surface portions the centre of the element has a thicker-walled form 252 including an axial spigot 253 communicating through the flexible wall into the part-chamber formed between the flexible wall and the pump body beneath.

The upper resiliently deformable member 15 has a similar form as regards the deformable wall portion, with facets 157 intersecting with cylindrical segments 159, but the peripheral structure differs. The outermost structure is a stiff cylindrical securing ring 151, deeper than that of the lower member, and this fits up against the top end of the actuator cap 3 with its top edge held in an annular groove 38. It connects to the flexible faceted surface through a narrow annular connecting web 154 in a radial plane. From the inside edge of this web 154 the resiliently deformable wall 156 extends inwardly and downwardly, inverted relative to the lower member 25. Above the thick web 154 there is an upstanding cylindrical skirt formation 155, tapering in thickness, which constitutes an outlet valve flap. In the installed condition this bears against a valve seat 34 provided by a generally cylindrical downward projection from the top wall 310 of the actuator cap 3. With reference to FIG. 2, the top of the actuator cap, the upstanding upward valve flap 155, the securing ring 151 and the integral radial web 154 define between them the annular discharge channel 322 or discharge chamber which extends around the top of the cap and leads to the circumferentially-local spout discharge channel 321.

At its centre thick formation 152 the upper member 15 comprises integrally the elongate axial connecting tube 20 which at its inner (upper) end opening has an in-turned annular lip or bead 157 and at its lower end plugs onto the central spigot 253 of the lower flexible member 25.

At the centre of the top wall 310 of the actuator cap 3 a sealing pin 33 with an enlarged blocking end 331 projects down into the top opening of the connecting tube 20. Its enlarged end is a force fit past the in-turned lip 157 there, but fits with clearance in the main bore of the connecting tube 20 so that fluid can communicate through except when the actuator cap 3 is at its highest extension—as in FIG. 2—when the enlarged pin end blocks the top of the connecting tube and forms a seal preventing the escape of product from the pump; useful when it is carried.

FIG. 3 shows that the upper and lower deformable pump-chamber-defining members 15,25 are moulded initially in one piece, desirably from polypropylene, connected by an integral link piece 160. They can remain connected by this when they are folded face to face to plug the connecting tube 20 onto the spigot 253 as seen in FIG. 4.

The overall compressible pump chamber is constituted in combination by the top pump chamber 150, defined between the upper deformable member 15 and the top of the actuator cap 3, the lower pump chamber 250 defined by the lower deformable member 25 and the pump body 4 and inlet valve below, and the connecting tube 20 which is however not compressible. We find that by combining two of the specially-shaped deformable polypropylene membranes, a better restoring force can be achieved for a given pump chamber volume than with the prior art. Accordingly, an effective pump dispenser can be made without a metal pump spring. Moreover an outlet valve is formed integrally with the polypropylene of the top pump chamber which brings economies in component count.

Indeed, in this embodiment polypropylene is used also for the inlet-side valve formations to be described next, so that all the elements for the pump are of polypropylene which is notably economical and recycling-friendly.

The inlet valve and venting arrangements are described with reference to FIGS. 2, 6, 7 and 8. As mentioned, the pump body 4 has a central inlet recess 48 to seat the inlet valve. The surrounding cover flange portion 43 of the body has a set of vent holes 44 which—as seen from FIG. 2—communicate with the exterior through the (non-airtight) connecting threads of the body and container neck. The inlet valve 51 is comprised in a larger valve body 5, a one-piece polypropylene moulding shown in FIG. 7. On the left in the figure is an inlet valve surround element 52 with a peripheral securing ring 53 that fits around inside the securing ring 251 of the lower pump chamber member. This is connected to a central recessed portion 54 via a sloping frusto-conical cover region 59 which, as seen in FIG. 2, defines an annular clearance above the vent holes 44 in the body cover flange 43. The central recessed part 54 of the valve body surround sits conformingly down in the corresponding central inlet recess 48 of the body 4.

The inlet valve is a flat flap 51 connected to the surround by integral thin flexible legs 511 so that it can be lifted off the corresponding seat 46 of the body by forward fluid pressure drawn up through the inlet 45. The valve body recess region 54 fits loosely in the body inlet recess 48 so that air can get between them from the previously-mentioned clearance to upstream of the inlet valve, compensating for dispensed product. This is facilitated—see FIG. 6(*b*)—by vent notches 40 at the angle where the flange 43 meets the inlet recess 48.

Figure 8B:
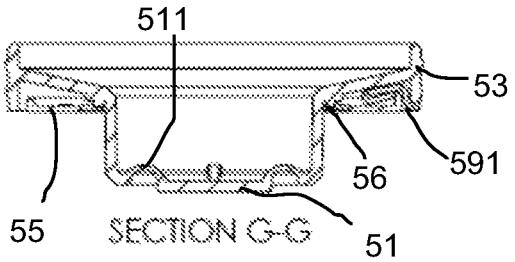
Figure 8A:
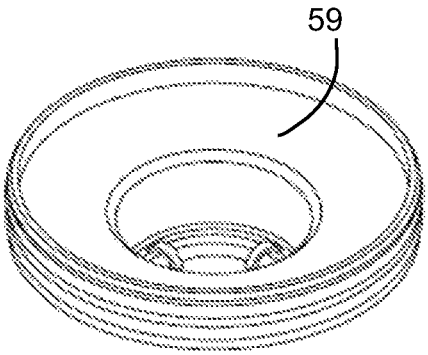
Figure 8C:
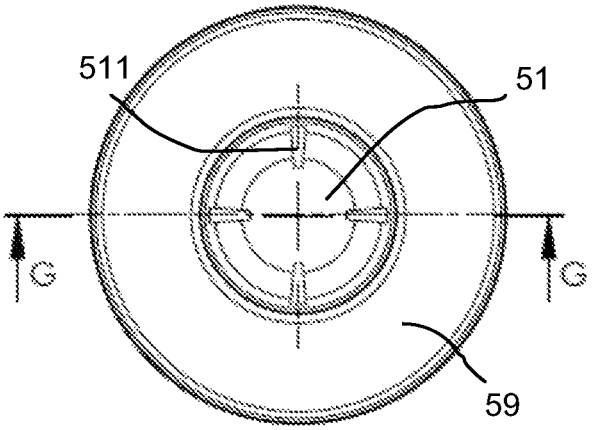

To control venting, and to prevent ingress of contaminants and escape of product through the vent, a vent seal is provided. In this embodiment it is by an annular vent valve flap 55 formed in one piece with the inlet valve body 5—the vent valve part and the inlet valve part are joined by a nexus piece 591 in the moulding. The vent valve flap 55 is connected by a series of thin flexible legs 551 to an inner holding ring 56. For assembly, the vent valve part is folded under the inlet valve part and the holding ring 56 fitted up around the recessed part 54 of the inlet valve surround. The vent valve flap 55 and its holding ring 56 can be slid up level with the outer support ring 53, as shown in FIG. 8(*b*), and when installed on the pump body the vent valve flap 55 overlies the body flange vent holes 44 to prevent escape of material while allowing air to enter. The retaining ring 251 of the lower deformable member 25 is sandwiched between the retaining ring 53 of the inlet valve surround 52 and the support surround 49.

A further feature of interest is locking of the actuator cap 3. Around the inner periphery of its downward mouth 37 it has a set of four inwardly-projecting circumferentially-extending retaining lugs 36. These are caught under the outside edge of the pump body flange 43 to hold the actuator cap down in place on the body against an expansion tendency of the flexible chamber walls, which are slightly precompressed. By appropriate rotation of the cap around its axis, the retaining lugs 36 are also engageable above a corresponding set of locking shelves 50, which project down below the support surround 49 of the pump body 4 and then prevent depression of the actuator i.e. lock the dispenser. The left side of FIG. 2 shows the engagement.

Thus, in the extended (up) position of the plunger/actuator cap it is lockable against actuation by a simple external mechanism (difficult with a conventional piston-cylinder pump), and at the same time sealed against product escape by the engagement of the sealing pin 33 in the connecting tube 20 under the natural bias of the flexible members 15,25 towards expansion.

On dispensing, depression of the plunger compresses both the upper and lower deformable pump-chamber-defining members 15,25, inverting their pyramidal faces and storing restitution energy for the subsequent return stroke of the pump. Product in the lower part-chamber is driven up through the connecting tube 20, past the pin 33 which no longer blocks once well into the tube 20, and into the top part-chamber for discharge via the outlet valve flap 155, annular discharge chamber 322 and discharge outlet 32.

It will be appreciated that the outlet valve could take other forms, but preferably with the movable element of the valve such as a flap being formed integrally with the pump chamber component or adjacent actuator component to minimise the component count.

The skilled person will also appreciate that while a specific embodiment has been described to illustrate the general ideas put forward herein, they may be implemented in a wide range of embodiments.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A pump dispenser comprising a pump having a deformable pump chamber with an inlet and an outlet, and a pump actuator operable relative to a body of the pump to vary the volume of the deformable pump chamber for pumping, wherein the pump chamber comprises a first part-chamber with rigid side walls and the inlet disposed separately from a deformable wall formed at a top of the first part-chamber; a second part-chamber with rigid sidewalls and the outlet disposed separately from a deformable wall at a bottom of the second part-chamber; and a connecting conduit connected to the deformable walls so as to separate the first and second part-chambers; and wherein the first and second part-chambers are both compressed at the same time by the pump actuator in a dispensing stroke thereof.

2. The pump dispenser of claim 1 in which the first and second part-chambers are compressed towards one another by the pump actuator in the dispensing stroke.

3. The pump dispenser of claim 1 in which the first and second part-chambers are disposed in line between the pump body and the pump actuator and wherein the pump actuator is moved towards the pump body in the dispensing stroke.

4. The pump dispenser of claim 3 in which each of the first and second part-chambers has a rigid wall portion and a deformable wall portion, said first and second part-chambers disposed with the respective deformable wall portions of each facing the other.

5. The pump dispenser of claim 4 in which the connecting conduit is non-deformable, thereby causing the deformable wall portions to collapse by the actuator in the dispensing stroke.

6. The pump dispenser of claim 4 in which the deformable wall portions of the first and second part-chambers are resiliently deformable and return the pump to an extended position after the dispensing stroke.

7. The pump dispenser of claim 4 in which one or both of the deformable wall is/or are a resiliently restorable non-elastomeric flexible wall comprising a plurality of mutually angled facets, at least one facet having a concave boundary, and a curved surface portion which interrupts the facet to induce bending thereof in the dispensing stroke so as to resiliently restore the flexible wall to an extended position.

8. The pump dispenser of claim 1 in which the pump inlet is in one of the part-chambers and the outlet is in the other.

9. The pump dispenser of claim 1 in which one or both of the deformable wall is/or are a resiliently restorable non-elastomeric flexible wall made of polypropylene.

10. The pump dispenser of claim 1 in which the deformable walls of the first and second chambers are each formed as separate, single pieces.

11. The pump dispenser of claim 10 in which each of the separate, single pieces also includes the connecting conduit.

12. The pump dispenser of claim 1 in which the part-chambers are constituted by a rigid body member, said pump actuator member is constructed and arranged to be reciprocable relative to the rigid body member, and including a first one-piece resiliently deformable wall component defining the first part-chamber in combination with the body member and a second one-piece resiliently deformable wall component defining the second part-chamber in combination with the actuator member, the connecting conduit being a rigid tube extending between them.

13. The pump dispenser of claim 1 in which all of the pump components are of polypropylene.

* * * * *